United States Patent [19]

Navarro

[11] Patent Number: 4,562,088

[45] Date of Patent: Dec. 31, 1985

[54] PROCESS AND APPARATUS FOR MAINTAINING A CONSTANT FLOW RATE IN A PAINTING SYSTEM

[75] Inventor: Richard R. Navarro, North Olmsted, Ohio

[73] Assignee: Nordson Corporation, Amherst, Ohio

[21] Appl. No.: 617,690

[22] Filed: Jun. 6, 1984

[51] Int. Cl.[4] ..... B05D 1/02; B05C 5/00

[52] U.S. Cl. ..... 427/8; 427/421; 118/667; 118/692; 118/712

[58] Field of Search ..... 118/667, 712, 300, 313, 118/315, 692; 427/8, 421, 422; 239/75

[56] References Cited

U.S. PATENT DOCUMENTS 2,914,253 11/1959 Tobus et al. ..... 239/75 X 4,263,091 4/1981 King ..... 239/75 X

*Primary Examiner*—John D. Smith

*Assistant Examiner*—Kenneth Jaconetty

*Attorney, Agent, or Firm*—Oldham, Oldham & Weber Co.

[57] ABSTRACT

Apparatus and techniques for maintaining a constant flow rate of a coating material in a painting system are presented. A test loop is provided in shunt with the conduit passing a coating material in a painting system. The test loop determines a sensitivity factor for the coating, establishing for that coating a relationship between temperature changes and pressure. That sensitivity factor is then used to regulate the pressure at the spray nozzles to compensate for temperature changes experienced in the coating material.

15 Claims, 6 Drawing Figures

PROCESS AND APPARATUS FOR MAINTAINING A CONSTANT FLOW RATE IN A PAINTING SYSTEM

TECHNICAL FIELD

The invention herein resides in the art of systems for spraying paint or other viscous coatings onto work pieces. More particularly, the invention relates to a process and apparatus for maintaining a constant mass flow rate for painting systems irrespective of temperature changes. The desired result is achieved by regulating the pressure at which the coating material is delivered through a spray nozzle as a function of the temperature of the coating.

BACKGROUND ART

Heretofore, painting systems have been known wherein one or more spray guns or nozzles are so positioned within a spray booth as to uniformly deposit a coating on a work piece passed therethrough. Such coatings are typically of a viscous nature, comprising paint, varnish, asphaltums, vinyls, and the like. It is known that the viscosity of such coatings changes with the temperature of the coating material, such changes occurring with changes in the ambient temperature in which the spraying apparatus is maintained.

The coating material is emitted from a spray gun or nozzle under pressure. The pressure determines the flow rate of the coating from the nozzle. This flow rate is the amount of coating emitted from the nozzle in a unit of time. Presently, at the beginning of the operation of the painting system, a technician adjusts the pressure at which the coating material is emitted from the spray nozzles, such adjustment generally occurring early in the day when the coating line is set up at the beginning of a work shift. As the temperature of the plant rises through the day, the temperature of the coating similarly rises, changing the viscosity of the coating. As the viscosity of the coating changes, the flow rate from the nozzles similarly changes. In most instances, if the temperature has increased, the viscosity of the coating decreases and, for a fixed pressure, the flow rate from the nozzles increases. The result is an excessive depositing of the coating on the work piece, producing runs, splatters, or an undesirable excessive coating of the material.

Because temperature changes in the coating material are not at all uncommon, there is required a method and apparatus by which a continuous monitoring of the coating temperature may be achieved and whereby periodic adjustments of the delivery pressure of the coating may be made. The result would be a uniform desired deposit of the coating material on the work pieces irrespective of temperature changes.

The prior art known to applicant teaches various techniques for metering a film or coating onto a work piece. However, none of the art known to applicant teaches an apparatus or technique to compensate for viscosity changes by regulating the gun or nozzle pressure. Specifically, no known art teaches the regulation of nozzle pressure as a function of the coating temperature. Art known to applicant, but only of general interest, consists of U.S. Pat. Nos. 3,077,858; 3,278,843; 3,453,984; 3,527,662; 3,801,349; 4,013,038; 4,224,355; and 4,396,640.

DISCLOSURE OF INVENTION

In light of the foregoing, a first aspect of the invention is the provision of an apparatus and technique by which the temperature of a coating material may be periodically monitored.

Another aspect of the invention is the provision of a technique and apparatus by which pressure adjustments may be made at the spray nozzles to compensate for viscosity changes resulting from temperature changes, thus maintaining a constant mass flow rate.

Yet another aspect of the invention is the provision of the technique and apparatus wherein the monitoring of temperature and the adjustment of pressure may be made on line, while the painting system remains in operation.

Still a further aspect of the invention is the provision of the technique and apparatus capable of determining the sensitivity or relationship between temperature and pressure for a particular coating.

Still another aspect of the invention is the provision of a technique and apparatus which achieves continuous and uniform coating of work pieces and which is accurate, cost effective, and easily implemented with presently existing painting systems.

The foregoing and other aspects of the invention which will become apparent as the detailed description proceeds are achieved by the improvement in a painting system having a source of coating material in communication through a first conduit with a spray nozzle for spray coating the coating material onto a work piece wherein an apparatus is provided for maintaining a constant flow rate of the coating material from the spray nozzle, comprising: a first temperature sensor in the first conduit adjacent the spray nozzle, to generate an output signal corresponding to the temperature of the coating at the nozzle; a first pressure regulator in the first conduit adjacent the spray nozzle for regulating the pressure at which the coating is delivered to the spray nozzle; first means interposed in the conduit for sensing information corresponding to the relationship between temperature and pressure of the coating relative to the flow rate of the coating; and second means interconnected with said first temperature sensor, first pressure regulator, and said first means for receiving said information and said output signal from the first temperature sensor to regulate said first pressure regulator to maintain a constant flow rate of the coating from the nozzle.

Other aspects of the invention are achieved by the process for maintaining a fixed mass flow rate of coating from the spray nozzle of a painting system, comprising: determining the relationship between temperature and pressure for the coating to maintain a constant flow rate; sensing a temperature change in the coating at the spray nozzle; and adjusting the pressure at the nozzle at which pressure the coating is sprayed.

BRIEF DESCRIPTION OF THE DRAWINGS

For a complete understanding of the objects, techniques, and structure of the invention, reference should be had to the following detailed description and accompanying drawings wherein.

BEST MODE FOR CARRYING OUT THE INVENTION

Figures 1, 2:
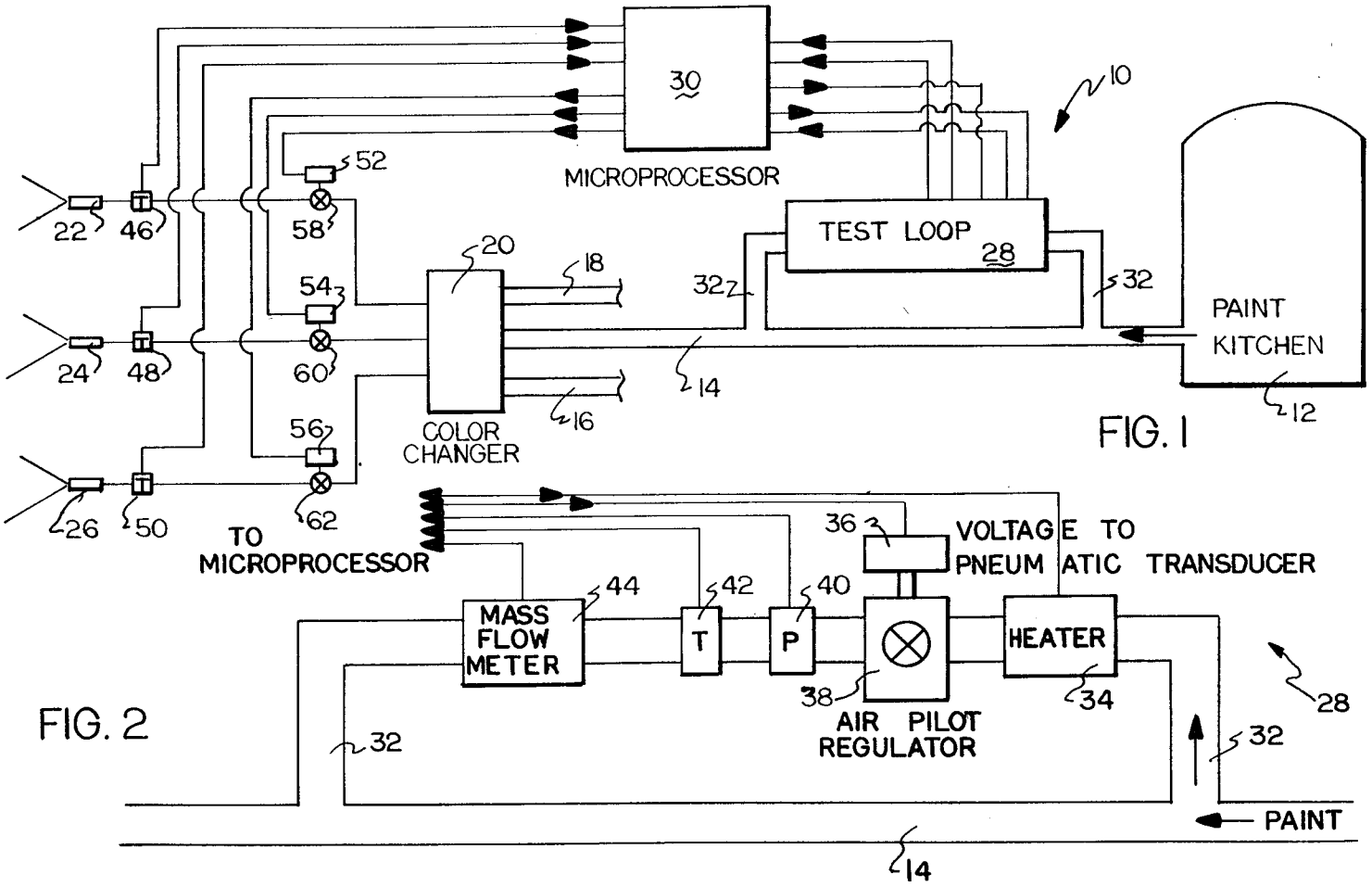
FIG. 1 is a schematic diagram of a painting system embodying the concept of the invention.
FIG. 2 is a schematic diagram of a first test loop which may be embodied in the structure of FIG. 1.

Referring now to the drawings, and more particularly to FIG. 1, it can be seen that a painting system is designated generally by the numeral 10. The system 10 includes a paint kitchen 12 wherein paint or other coating materials are maintained in drums or other suitable containers. Typically, the paint kitchen 12 would include mixers to keep the coating homogenized, and would further include containers of different coatings such that selections of various coatings may be readily made. Coating conduits 14–18 communicate with the containers in the paint kitchen for delivery of the coatings maintained therein. A coating or color changer 20 is provided such that an operator may select one of the conduits 14–18 for delivery to the spray nozzles. For example, in the case of paint, the color changer 20 could select one of three different colors of paints maintained in the paint kitchen 12. Color changer structures are well known in the art and need not be elaborated upon herein in that they do not form a part of the invention.

The paint from the kitchen 12 is passed under pressure through one of the conduits 14–18 to the spray guns or nozzles 22–26. Of course, the spray nozzles 22–26 are specifically positioned such that a uniform coating of the spray material is deposited on the work piece.

Of particular interest to the invention herein is the provision of a test loop 28 provided in shunt with the conduits 14–18 just described. A microprocessor or other suitble type of digital processor 30 is provided in intercommunication between the test loop 28 and the spray nozzles for purposes which will become apparent hereinafter.

With reference now to FIG. 2, it can be seen that the test loop 28 communicates with the conduits 14–18 via the conduit 32. Only the test loop communicating with the conduit 14 is shown for purposes of simplicity. The test loop 28 includes a heater 34 which is connected to and controlled by the microprocessor 30. The unit 34 is interposed in the conduit 32 such that the coatings passing through the conduit also pass through the heater. A voltage to pneumatic transducer 36 is interconnected with an air pilot regulator 38 which is also interposed in the conduit 32. The air pilot regulator 38 is controlled by the microprocessor 30 and receives a voltage signal which corresponds to an air pressure. This air pressure is applied to a diaphragm in the air pilot regulator 38 to regulate or control the pressure of the coating passing therethrough. The utilization of a voltage to pneumatic transducer 36 and an air pilot regulator 38 is well known to those skilled in the art and, for that reason, is not elaborated upon in detail. Suffice it to say that the elements 36,38 control the pressure at which the coating is delivered through the conduit 32 by means of application of a voltage under control of the microprocessor 30. Of course, a digital to analog converter may be included for the purpose of translating the signal from the microprocessor 30 to the voltage to pneumatic transducer 36.

A pressure transducer 40 may be interposed in the line 32 if desired. The transducer 40 presents an output signal to the microprocessor 30 indicative of the flow pressure of the coating in the conduit 32. Of course, the voltage supplied by the microprocessor 30 to the voltage to pneumatic transducer 36 is indicative of such pressure. The transducer 40 may be used to more accurately sense the pressure if pressure drops in the remainder of the conduit 32 are of concern.

A thermocouple or other temperature sensor 42 is also interposed in the conduit 32 to sense the temperature of the coating and to pass an electrical signal corresponding to such temperature to the microprocessor 30. Finally, a mass flow meter 44, communicating with the microprocessor 30, senses the mass flow rate of the coating through the conduit 32 and presents a signal to the microprocessor indicative of such rate. Such rate is typically measured in units of weight per unit time.

Utilizing the structure of the test loop of FIG. 2, the sensitivity of the coating material to changes in temperature may be determined. It has been empirically determined that many coatings used in painting systems exhibit a sensitivity factor b which can be determined by the following formula:

$$b = \frac{\ln(P_1/P_0)}{T_0 - T_1}$$

where $P_0$ is a reference pressure, $P_1$ is a new pressure, $T_0$ is the reference temperature corresponding to $P_0$, and $T_1$ is a new temperature corresponding to $P_1$. This equation provides means for determining the relationship between temperature and pressure for a given coating while maintaining a constant mass flow rate.

In utilizing the structure of the test loop of FIG. 2, it will be understood that a portion of the coating transmitted via the conduit 14 is diverted into the conduit 32. To determine $T_0$ and $P_0$ the heater 34 is left off. The coating passes through the air pilot regulator 38, pressure transducer 40, temperature sensor 42, and mass flow meter 44, then exits to the conduit 14. The pressure at which the coating is passed may be sensed by the microprocessor 30 from the pressure transducer 40. This pressure is the reference pressure $P_0$. In similar fashion, the microprocessor 30 determines the reference temperature $T_0$ from the temperature sensor 42. With the reference temperature $T_0$ and reference pressure $P_0$ now being known, the mass flow rate for these $P_0$, $T_0$ values is next determined via meter 44.

The microprocessor 30 next energizes the heater 34 to raise the temperature of the coating passing through the conduit 32 of the test loop 28 to some selected temperature above $T_0$. After microprocessor 30 has determined via sensor 42 that the temperature of the coating has stabilized, microprocessor 30 looks at the input from the mass flow meter 44. Under microprocessor control, the signal to the voltage to pneumatic transducer 36 is appropriately changed, regulating the air pilot regulator 38 to allow the mass flow rate to achieve its original or reference level. At this point, new readings of pressure and temperature are taken via the elements 40,42 respectively establishing the values of $P_1$ and $T_1$. The sensitivity factor b can now be determined from the equation:

$$b = \frac{\ln(P_1/P_0)}{T_0 - T_1}$$

Figure 4:
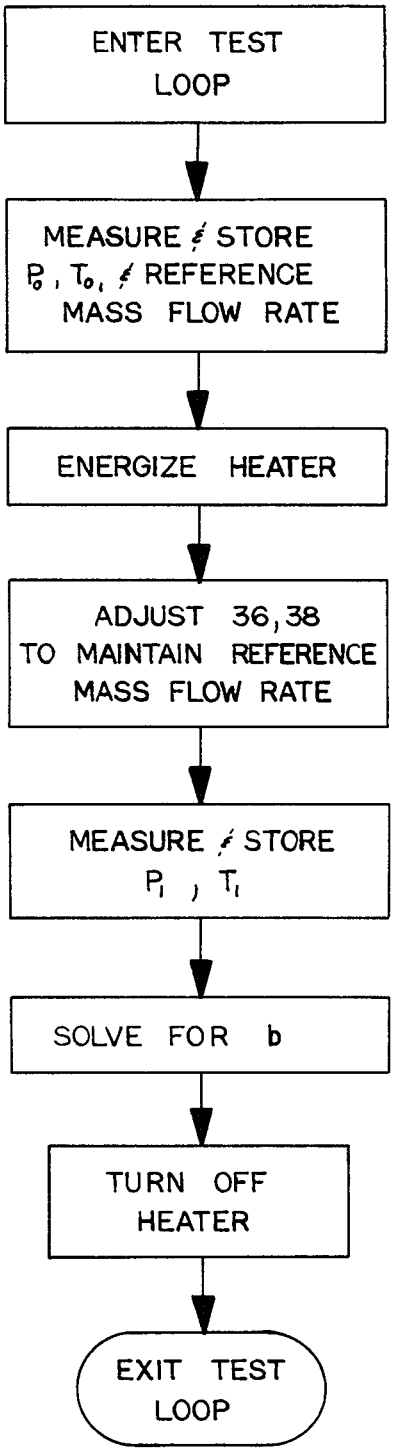
FIG. 4 is a flow chart of the procedure employed by the test loop of FIG. 2.

The procedure implemented by the microprocessor 30 to determine the sensitivity factor b according to the test loop of FIG. 2 is shown in the flow diagram of FIG. 4. Microprocessor 30 enters the test loop. It then measures and stores the reference pressure $P_0$, reference temperature $T_0$, and the reference mass flow rate. Heater 34 is then energized. After the temperature has stabilized, the air pilot regulator 38 is adjusted under microprocessor control to return to the reference mass flow rate. The new pressure $P_1$ and new temperature $T_1$ are then sensed. The microprocessor then solves the equation for b. The heater 34 is turned off and the microprocessor returns to other system control functions.

Note that in order to determine b there must be continual circulation through loop 28. This can be accomplished through various means. For example, the paint could circulate back to the paint kitchen from the end of loop 32, from the color changer, or even from a recirculation valve at the gun. Having determined the sensitivity factor b of the coating material, pressure adjustments can now be made at the spray nozzles 22–26 to compensate for any temperature changes which are experienced in the system. For an understanding of the required structure, reference is again made to FIG. 1. Here, it will be seen that temperature sensors 46–50, comprising thermistors, thermocouples, or the like, are uniquely associated with the spray nozzles 22–26. These temperature sensors 46–50 communicate with the microprocessor 30. In similar fashion, each of the spray nozzles 22–26 has associated with it a voltage to pneumatic transducer 52–56, corresponding in nature to the voltage to pneumatic transducer 36 of the test loop 28. Each voltage to pneumatic transducer 52–56 has uniquely associated therewith an air pilot regulator 58 ∝ 62, similar to the air pilot regulator 38 of the test loop 28. The temperature sensors 46–50, communicating with the microprocessor 30, provide means for monitoring the temperature at the spray nozzles 22–26, respectively. In similar fashion, the voltage to pneumatic transducers 52–56 and the air pilot regulators 58–62 provide means by which the microprocessor 30 may regulate and monitor the pressure at which the coating material is delivered to the respectively associated spray nozzles 22–26.

It will be appreciated that, when the system 10 is initiated, the operator may set the flow rate of each of the nozzles 22–26 in a well known manner by determining cup flow rates. This technique, known to those skilled in the art, requires that the operator receive in a cup the coating from one of the nozzles 22–26 over a fixed time period. The amount of coating received in the cup establishes the mass flow rate of that nozzle. The operator can modify the flow rate by appropriately adjusting the corresponding voltage to pneumatic transducer 52–56. This may be achieved either via a keyboard through the microprocessor 30 or by means of a manual override. In any event, such adjustment is made for each of the nozzles 22–26 via the associated voltage to pneumatic transducers 52–56. Once the nozzles 22–26 have been so initiated, the corresponding pressure setting for each value is stored as $P_0$. Likewise, the temperatures $T_0$ are sensed by the associated temperature sensors 46–50 and are stored by the microprocessor 30. Since the sensitivity factor b has already been determined by means of the test loop of FIG. 2, microprocessor 30 can now periodically monitor the temperature $T_1$ of the coating at the nozzles 22–26 and make appropriate pressure adjustments via the elements 52–62 by solving the equation:

$$P_1 = P_0 e^{b(T_0 - T_1)}$$

So long as $T_1 = T_0$, the equation will yield $P_1 = P_0$ and no adjustment will be made. Once $T_1$ varies from $T_0$, however, $P_1$, as determined by the equation, will no longer equal $P_0$, and the microprocessor will vary the nozzle pressure via the appropriate element 52–62 to maintain the desired flow rate.

Figure 6:
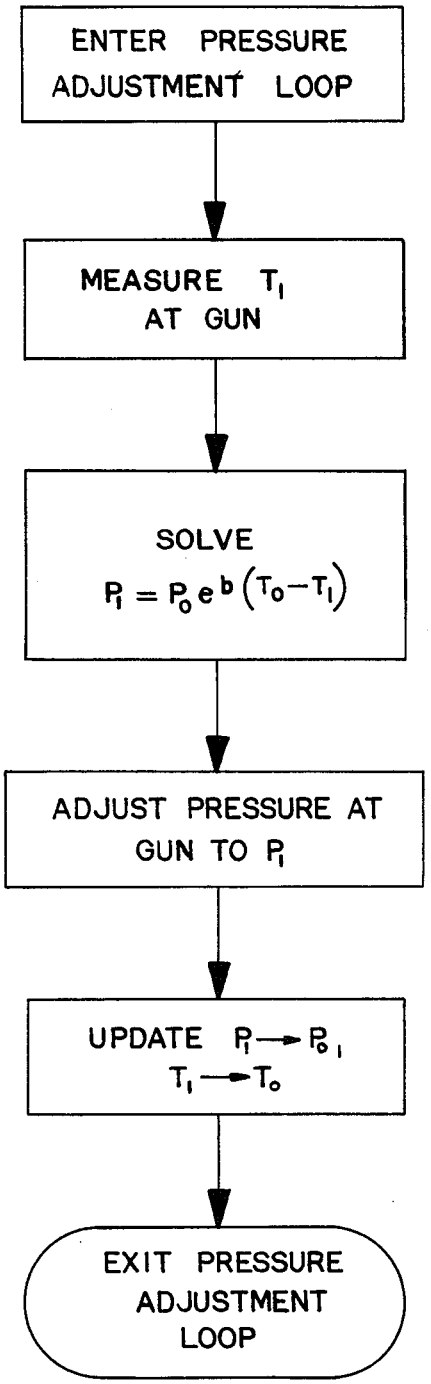
FIG. 6 is a flow chart of the pressure adjustment technique applied to the spray nozzle.

Further understanding of the adjustment technique described above may be had by means of FIG. 6 which illustrates the flow diagram followed by the microprocessor 30. It will be appreciated that the flow diagram is for the adjustment of but a single spray nozzle, the loop being entered once for each of the nozzles 22–26. In any event, the new temperature $T_1$ is measured at the associated nozzle or gun. The equation is then solved for $P_1$. The pressure at the gun is adjusted via the appropriate voltage to pneumatic transducer to equal $P_1$. The microprocessor then exits the adjustment loop and returns to other control functions.

Figure 3:
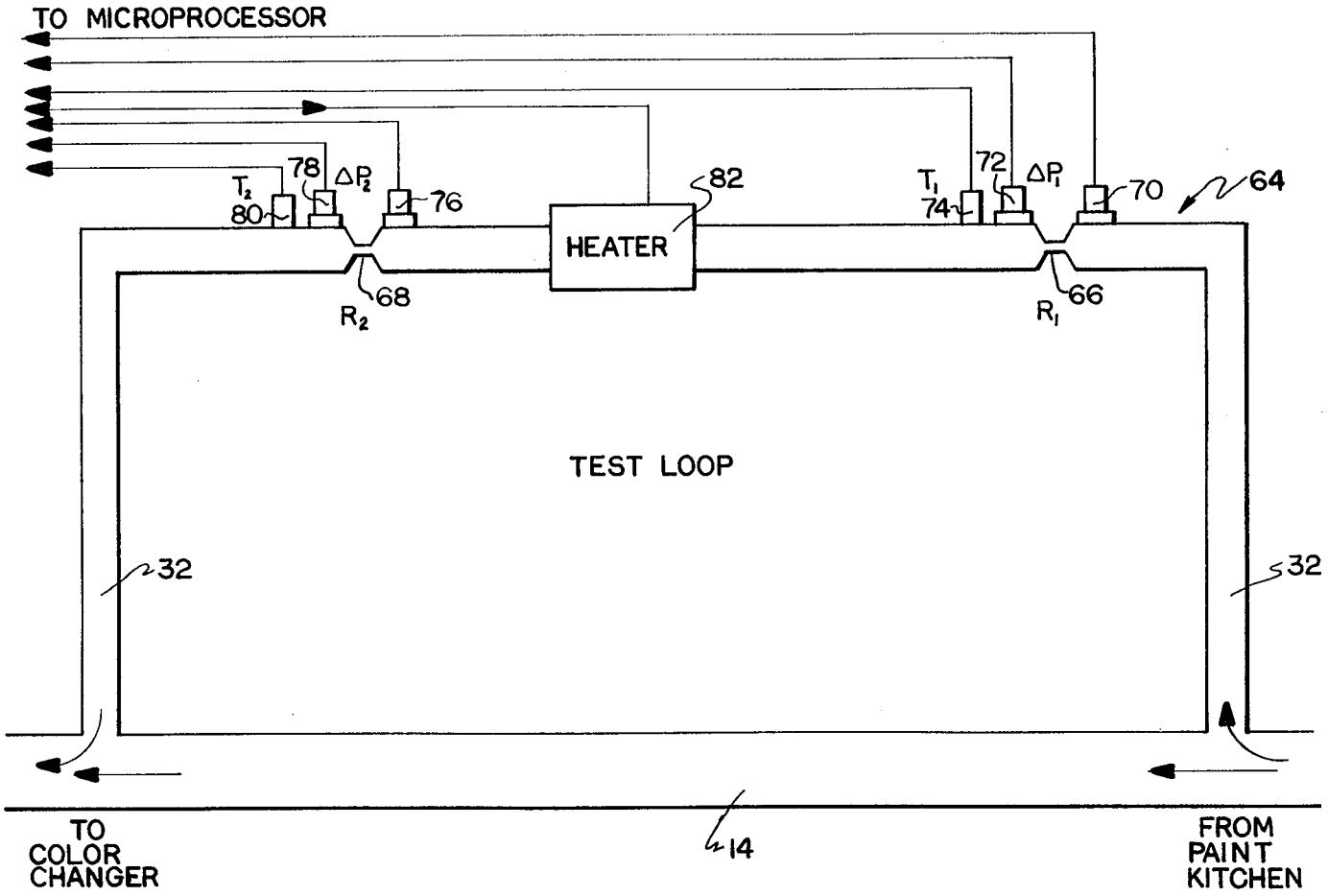
FIG. 3 is a schematic diagram of a second test loop which may be embodied in the structure of FIG. 1.

A second test loop contemplated as an alternative embodiment of the invention herein is shown in FIG. 3. Here it will be seen that the test loop is designated generally by the numeral 64, but may be readily substituted in FIG. 1 for the test loop 28. Again, a conduit 32 diverts a portion of the coating from the conduit 14 for purposes of determining the sensitivity factor b. Here, the conduit 32 has first and second restrictions 66,68 therein. The necessity for a flow meter is eliminated in this embodiment. The restrictions are, as shown, equal size diameter reductions in the conduit 32. Pressure transducers 70,72 are interposed on either side of the first restriction 66, and a temperature sensor 74 is interposed closely adjacent the restriction 66. The pressure transducer 70 provides to the microprocessor 30 a signal indicative of the pressure of the coating before the restriction 66, while the pressure transducer 72 provides a signal corresponding to the pressure of the coating following the restriction 66. The temperature sensor 74 provides a signal to the microprocessor 30 corresponding to the temperature of the coating at the restriction 66.

Associated with the restriction 68 is a pressure transducer 76, providing the microprocessor with a signal indicative of the pressure of the coating before the restriction 68, while a pressure transducer 78 provides a signal corresponding to the pressures of the coating following the restriction 68. The temperature sensor 80 provides a signal corresponding to the temperature of the coating at the restriction 68. A heater 82, energized under control of the microprocessor 30, raises the temperature of the coating in the conduit 32 such that the temperature $T_1$ sensed by the temperature sensor 74 is greater than the temperature $T_2$ sensed by the temperature sensor 80.

The structure of FIG. 3 relies upon the law of conservation of mass. Accordingly, the mass flow rate through the restriction 66 equals the mass flow rate through the restriction 68. There are, however, pressure drops across each of the restrictions 66,68. The pressure drop across the restriction 66, $\Delta P_1$ is determined by the microprocessor 30 by sensing the outputs of the pressure transducers 70,72. In similar fashion, the microprocessor determines the pressure drop $\Delta P_2$ at the restriction 68 by sensing the pressure transducers 76,78. With this data, the inventor has empirically determined that the sensitivity factor b may be found according to the formula:

$$b = \frac{\ln(\Delta P_1/\Delta P_2)}{T_1 - T_2}$$

Figure 5:
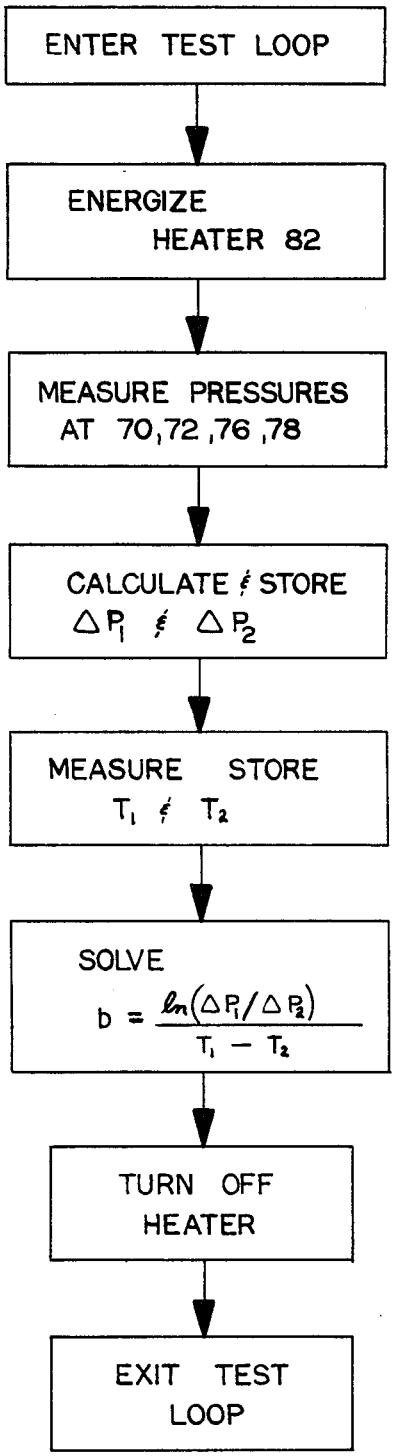
FIG. 5 is a flow chart of the procedure employed by the test loop of FIG. 3.

The microprocessor may determine the sensitivity factor b utilizing the structure of FIG. 3 by following the procedure set forth in the flow diagram of FIG. 5. Here, it can be seen that the microprocessor enters the test loop, and energizes the heater 82. Once the temperature of the coating has stabilized, the microprocessor measures the pressures in the conduit 32 at the various points of interest by sensing the output signals of the pressure transducers 70,72,76,78. Knowing these pressures, $\Delta P_1$ and $\Delta P_2$ can be calculated. The microprocessor next measures the temperature $T_1$ at the restriction 66 and the temperature $T_2$ at the restriction 68. It then solves for the sensitivity factor according to the formula:

$$b = \frac{\ln(\Delta P_1/\Delta P_2)}{T_1 - T_2}$$

The heater is now turned off and the microprocessor exits the test loop to perform other functions. Knowing the sensitivity factor b, the microprocessor may regulate the pressures at the spray nozzles 22–26 of FIG. 1 by the technique described hereinabove and particularly with respect to FIG. 6.

It should be understood that the test procedure utilizing the test loop 64 differs from that utilizing test loop 28 in that the test loop 64 requires but a single pass of coating through the test loop to determine the sensitivity factor b. By interposing the heater between the two restrictions, the heater may be energized during the entire test loop. Further, this benefit is derived by utilizing identical restrictors 66,68 and relying upon the law of conservation of mass, eliminating the need for a mass flow meter.

Thus it can be seen that the objects of the invention have been achieved by the structure and techniques presented and described hereinabove. While in accordance with the patent statutes only the best modes and preferred embodiments of the invention have been presented and described in detail, it should be understood that the invention is not limited thereto or thereby. In particular, it is intended to be understood that a test loop type structure would not necessarily be required to practice the invention. For example, sensitivity factors for a coating could be determined independently of the particular painting system and then input to the control system computer in the form of a table. The microprocessor would then merely sense the temperature of the paint and regulate the pressure of the spray nozzle to maintain constant flow according to the "look-up table" type information stored in the computer's memory. Accordingly, for an appreciation of the true scope and breadth of the invention, reference should be had to the appended claims.

What is claimed is:

1. In a painting system having a source of coating material in communication through a first conduit with a spray nozzle for spray coating the coating material onto a work piece, an apparatus for maintaining a constant flow rate of the coating material from the spray nozzle, comprising:

a first temperature sensor in the first conduit adjacent the spray nozzle, presenting a first output signal corresponding to the temperature of the coating at the nozzle;

a first pressure regulator in the first conduit adjacent the spray nozzle, for regulating the pressure at which the coating is delivered to the spray nozzle;

first means interposed in the conduit for determining the relationship between temperature and pressure of the coating relative to the flow rate of the coating and presenting a second output signal representative of said relationship; and second means interconnected with said first temperature sensor and said first pressure regulator for receiving said first and second output signals and for regulating said first pressure regulator as a function of said output signals to maintain a constant flow rate of the coating from the nozzle.

2. The improvement according to claim 1 wherein said first means comprises:

a mass flow meter connected to said second means and presenting an output signal thereto indicative of the mass flow rate of the coating therethrough;

a second pressure regulator connected to and controlled by said second means for maintaining a constant flow rate to said mass flow meter; and a second temperature sensor adjacent said mass flow meter and connected to said second means and presenting to said first means an ouput signal corresponding to the temperature of coating passing to said mass flow meter.

3. The improvement according to claim 2 wherein said first means further comprises a heater connected to said first means for selectively heating the coating passing to said mass flow meter under control of said first means.

4. The improvement according to claim 3 wherein said second means determines said relationship between temperature and pressure of the coating according to the equation:

$$b = \frac{\ln(P_1/P_0)}{T_0 - T_1}$$

where b is a sensitivity factor of the coating, $P_0$ is a reference pressure, $P_1$ is a new pressure, $T_0$ is the temperature of the coating at the pressure $P_0$, and $T_1$ is the temperature of the coating at the pressure $P_1$, and where the mass flow rate of the coating is the same at $P_0$, $T_0$, and $P_1$, $T_1$.

5. The improvement according to claim 4 wherein said second means comprises a digital processor and wherein said first means is maintained in a second conduit in shunt with said first conduit.

6. The improvement according to claim 3 wherein said first and second pressure regulators pass the coating therethrough at pressures proportional to signals received from said second means.

7. The improvement according to claim 3 wherein said first and second temperature sensors comprise thermocouples.

8. The improvement according to claim 1 wherein said first means is maintained in a second conduit in shunt with said first conduit and comprises:

a first restriction in said second conduit;

first and second pressure sensors on either side of said first restriction and connected to said first means;

a second restriction in said second conduit;

third and fourth pressure sensors on either side of said second restriction and connected to said second means;

a second temperature sensor adjacent said second restriction and connected to said first means; and a third temperature sensor adjacent said second restriction and connected to said first means.

9. The improvement according to claim 8 wherein said first means further comprises a heater interposed in said second conduit between said first and second restrictions and controlled by said first means.

10. The improvement according to claim 9 wherein said second means determines said relationship between temperature and pressure of the coating according to the equation:

$$b = \frac{\ln(\Delta P_1/\Delta P_0)}{T_0 - T_1}$$

where b is a sensitivity factor of the coating, $\Delta P_0$ and $\Delta P_1$ are respectively the pressure drops of the coating across said first and second restrictions, and $T_0$ and $T_1$ are respectively the temperatures of the coating at said first and second restrictions.

11. The improvement according to claim 10, wherein said second means comprises a digital processor.

12. The improvement according to claim 11, wherein said digital processor receives signals from said first and second pressure sensors and determines $\Delta P_0$ therefrom, receives signals from said third and fourth pressure sensors and determines $\Delta P_2$ therefrom, and receives signals from said second and third temperature sensors and determines $T_0$ and $T_1$ therefrom, respectively.

13. The improvement according to claim 9 wherein said temperature sensors comprise thermocouples.

14. A process for maintaining a fixed mass flow rate of coating from a spray nozzle comprising the steps of:

determining the relationship between temperature and pressure for the coating to maintain a constant flow rate by:

measuring a reference temperature $T_0$ and reference pressure $P_0$ of the coating for a flow rate value;

heating the coating to temperature $T_1$ different than $T_0$;

adjusting the pressure applied to the coating to return to said flow rate value;

measuring the new temperature $T_1$, and new pressure $P_1$ of the coating; and determining the sensitivity factor b of the coating according to the equation $$b = \frac{\ln(P_1/P_0)}{T_0 - T_1};$$

sensing an initial temperature of the coating at the spray nozzle, at which initial temperature $T_i$ a desired mass flow rate of coating is attained from the spray nozzle at an initial pressure $P_i$; and periodically sensing the temperature of the coating at the spray nozzle to detect the existence of a new temperature $T_f$; and wherein pressure at the nozzle is adjusted to a new pressure $P_f$ to maintain a constant mass flow rate according to said equation;

$$P_f = P_i e^{b(Ti - Tf)}$$

where $T_i$ and $P_i$ are respectively said initial temperature and pressure and $T_f$ and $P_f$ are respectively said new temperature and pressure.

15. A process for maintaining a fixed mass flow rate of coating from a spray nozzle comprising the steps of:

determining the relationship between temperature and pressure for the coating to maintain a constant flow rate by:

passing the coating through first and second restrictions in a conduit;

heating the coating between said first and second restrictions;

measuring the temperatures $T_0$ and $T_1$ respectively at said first and second restrictions;

measuring pressure drops $\Delta P_0$ and $\Delta P_1$, respectively, across the first and second restrictions; and determining the sensitivity factor b of the coating according to the equation $$b = \frac{\ln(\Delta P_1/\Delta P_0)}{T_0 - T_1};$$

sensing an initial temperature $T_i$ of the coating at the spray nozzle, at which intial temperature a desired mass flow rate of coating is attained from the spray nozzle at an initial pressure $P_i$; and periodically sensing the temperature of the coating at the spray nozzle to detect the existence of a new temperature $T_f$; and wherein pressure at the nozzle is adjusted to a new pressure $P_f$ to maintain a constant flow rate according to the equation:

$$P_f = P_i e^{b(Ti - Tf)}$$

wherein $T_i$ and $P_i$ are respectively said initial temperature and pressure and $T_f$ and $P_f$ are respectively said new temperature and pressure.

* * * * *